US005226837A

United States Patent [19]

Cinibulk et al.

[11] Patent Number: 5,226,837

[45] Date of Patent: Jul. 13, 1993

[54] ENVIRONMENTALLY PROTECTED CONNECTION

[75] Inventors: Walter Cinibulk, Palo Alto; Peter Godfrey, Union City, both of Calif.; David Vatcher, Swindon, England

[73] Assignee: Raychem Corporation, Menlo Park, Calif.

[21] Appl. No.: 968,243

[22] Filed: Oct. 29, 1992

Related U.S. Application Data

[63] Continuation of Ser. No. 614,348, Nov. 16, 1990, abandoned.

[51] Int. Cl.[5] ..... H01R 13/52

[52] U.S. Cl. ..... 439/521; 439/936

[58] Field of Search ..... 174/76, 77 R, 138 F; 439/274–279, 281, 312, 320, 932, 936, 519, 520, 521

[56] References Cited

U.S. PATENT DOCUMENTS

| | | | |
|---|---|---|---|
| 2,027,962 | 3/1933 | Currie | 18/55 |
| 3,086,242 | 7/1960 | Cook et al. | 18/1 |
| 3,423,518 | 1/1969 | Weagant | 174/153 |
| 3,515,798 | 12/1968 | Sievert | 174/135 |
| 3,597,372 | 8/1971 | Cook | 260/4 |
| 4,070,746 | 1/1978 | Evans et al. | 29/450 |
| 4,076,360 | 2/1987 | Singh . | |
| 4,186,986 | 2/1980 | Shoemaker . | |
| 4,600,261 | 7/1986 | Debbaut . | |
| 4,690,831 | 9/1987 | Uken et al. | 427/44 |
| 4,702,710 | 10/1987 | Dittman et al. | 439/217 |
| 4,716,183 | 12/1987 | Gamarra et al. | 522/491 |
| 4,777,063 | 10/1988 | Dubrow et al. | 427/44 |
| 4,852,646 | 8/1989 | Dittmer et al. | 165/185 |
| 4,864,725 | 9/1989 | Debbaut | 29/871 |
| 4,865,905 | 9/1989 | Uken | 428/220 |
| 4,868,967 | 9/1989 | Holt et al. | 29/450 |
| 4,963,698 | 10/1990 | Chang et al. | 174/76 X |
| 5,104,930 | 4/1992 | Rinde et al. | 524/871 |

FOREIGN PATENT DOCUMENTS

| | | |
|---|---|---|
| 0204427 | 5/1986 | European Pat. Off. . |
| 8601634 | 3/1986 | World Int. Prop. O. . |
| 8800603 | 1/1988 | World Int. Prop. O. . |
| 9010035 | 9/1990 | World Int. Prop. O. . |

*Primary Examiner*—Larry I. Schwartz
*Assistant Examiner*—Khiem Nguyen
*Attorney, Agent, or Firm*—Dennis E. Kovach; Herbert G. Burkard

[57] ABSTRACT

A cable connection is environmentally protected using an assembly which comprises a polymeric sleeve positioned over the coupling nut of the connector and a segment of the cable adjacent the connector, the polymeric sleeve being secured to said coupling nut so as to prevent motion between the sleeve and the nut and a layer of encapsulant positioned between at least a portion of the polymeric sleeve and the underlying cable, the encapsulant providing a circumferential environmental seal between the cable and the sleeve while permitting rotational motion between the cable and the sleeve. A further layer of encapsulant preferable extends from the coupling nut over the hardware mounting the connector receptacle into a bulkhead. This further layer of encapsulant is preferable contained in a cap to which a force is applied by a flange provided in the polymeric sleeve. The encapsulant is preferable a silicone gel.

16 Claims, 3 Drawing Sheets

ENVIRONMENTALLY PROTECTED CONNECTION

This application is a file wrapper continuation of application Ser. No. 07/614,348, filed Nov. 16, 1990 now abandoned.

BACKGROUND OF THE INVENTION

This invention comprises an assembly and method for environmentally protecting a cable connection.

Cables are connected using a variety of connectors and hardware to black boxes, bulkheads and production break connector receptacles. The connector typically has a metallic coupling nut which joins the connector on the cable end to the connector receptacle on the black box, or the like. The coupling mechanism may be provided with threads and are screwed together, or provided with bayonet connection means or the like. The metal components of the connection are subject to corrosion, the degree of corrosion depending on the environment in which it is located. Corrosion leads to the deterioration of the connection and even failure of the connectors. Further, it is generally desired that the connection be readily reenterable, that is that the connector and cable can be readily removed from the receptacle. Extensive corrosion of the connectors, plug and receptacle, and mounting hardware can prevent functionality and demating of the connectors. It is therefore desirable to provide a connection which is protected from the environment and resistant to corrosion. Further, the connectors should remain dematable.

SUMMARY OF THE INVENTION

One aspect of this invention comprises an assembly for environmentally protecting a cable connection in which an end of a cable is connected to a connector having a coupling nut, which assembly comprises:

a) a polymeric sleeve positioned over the coupling nut and a segment of the cable adjacent the connector, said polymeric sleeve being secured to said coupling nut so as to prevent motion between the sleeve and the nut; and b) a layer of encapsulant positioned between at least a portion of the polymeric sleeve and the underlying cable, the encapsulant providing a circumferential environmental seal between the cable and the sleeve while permitting rotational motion between the cable and the sleeve.

The assembly preferable further comprises a layer of encapsulant extending from the coupling nut over the hardware mounting a connector receptacle in a bulkhead to which the connector is coupled.

Another aspect of this invention comprises a method of environmentally protecting a cable connection which an end of a cable is connected to a connector having a coupling nut, which method comprises:

a) positioning a polymeric sleeve over the coupling nut and a segment of the cable adjacent the connector;

b) securing the polymeric sleeve to the coupling nut so that motion between the sleeve and the nut is prevented; and c) positioning an encapsulant between at least a portion of the sleeve and the underlying cable such that rotational motion is permitted between the cable and the sleeve.

The method preferable further comprises the step of securing the coupling nut to a connector receptacle mounted in a bulkhead and positioning a layer of encapsulant over hardware mounting the connector receptacle in the bulkhead. The term "bulkhead" is used in this patent application to cover any wall to which the cable is connected, including the wall of a "black box", a traditional bulkhead or the like. The term "black box" is used to cover any enclosure containing electrical or electronic components. The term "cable" is used to mean any bundle of wires and includes harnesses as well as cables. The cable may be terminated to the connector and the termination may be insulated using an initial polymeric sleeve or other appropriate means. The term cable embraces the insulated cable termination.

DETAILED DESCRIPTION OF THE INVENTION

Figure 1:
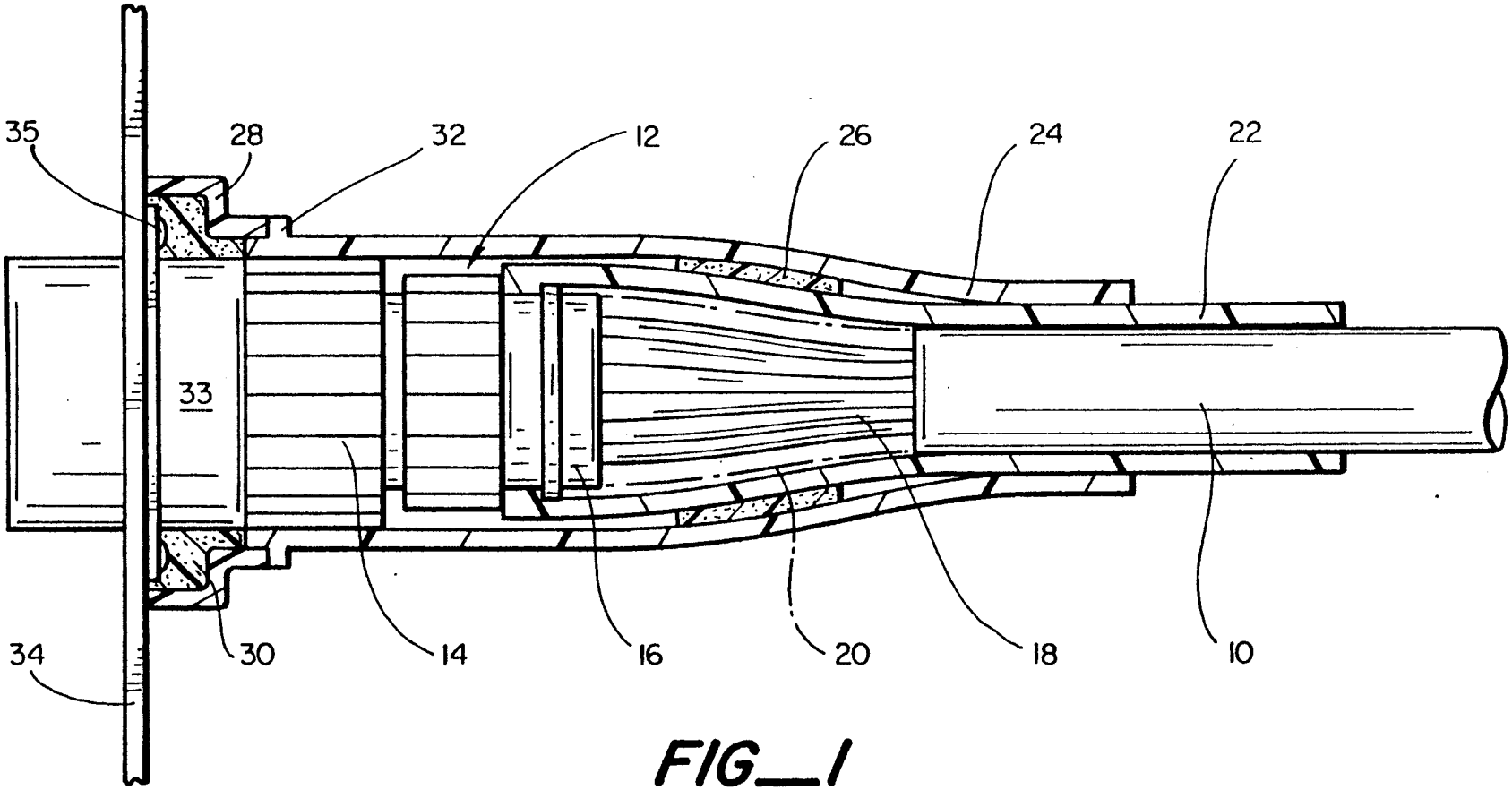
FIG. 1 shows in partial cross-section, an environmentally protected cable connection of the invention.

The polymeric sleeve positioned over the connector and adjacent cable end is preferable a dimensionally recoverable tubular article.

A dimensionally recoverable article is one whose dimensional configuration may be made to change when subjected to an appropriate treatment. Usually these articles recover, on heating, towards an original shape from which they have previously been deformed, but the term "heat-recoverable" as used herein also includes an article which, on heating, adopts a new configuration even if it has not been previously deformed.

In their most common form heat-recoverable articles comprise a heat-shrinkable sleeve made from a polymeric material exhibiting the property of elastic or plastic memory as described, for example, in U.S. Pat. Nos. 2,027,962, 3,086,242 and 3,597,372. As is made clear in, for example, U.S. Pat. No. 2,027,962, the original dimensionally heat-stable form may be a transient form in a continuous process in which, for example, an extruded tube is expanded immediately after extrusion, while hot, to a dimensionally heat-unstable form. In other embodiments a preformed dimensionally heat-stable article is deformed to a dimensionally heat-unstable form in a separate stage.

In the production of heat recoverable articles, the polymeric material may be crosslinked at any stage in the production of the article to enhance the desired dimensional recoverability. One manner of producing a heat-recoverable article comprises shaping the polymeric article into the desired heat-unstable form, subsequently crosslinking the polymeric material, heating the article to a temperature above the crystalline melting point of the polymer, deforming the article and then cooling the article while in the deformed state so that the deformed state of the article is retained. In use, since the deformed state of the article is heat-unstable, application of heat will cause the article to assume its original heat-stable shape.

Dimensionally recoverable articles suitable for use in this invention may be elastomeric sleeves held in an expanded configuration by an internal or external support. Such articles recover when released from the support, not on the application of heat and are sometimes referred to as "cold-shrink" articles. Such articles are described, for example, in U.S. Pat. No. 4,070,746 to Evans et al and U.S. Pat. No. 3,515,798 to Sievert, the entire disclosures of which are incorporated by reference.

The polymeric sleeve can also be a double wall tubular article such as that described in U.S. Pat. No. 4,868,967, the entire disclosure of which is incorporated by reference.

A preferred polymeric sleeve for use in this invention is relatively thick walled and is preferable prepared by molding the sleeve and then rendering it heat shrinkable as discussed above. The sleeve can be made of any polymeric material such as, polyethylene, polyvinylidene fluoride, silicone rubber, or the like.

The cable may be connected in line or at 90° to the connector. If it is connected at 90°, the polymeric sleeve can have a 90° bend or can be sufficiently short that it comes down on the cable before it bends.

The polymeric sleeve is secured to the coupling nut of the connector so that rotational motion between the sleeve and the nut is prevented. Preferable the polymeric sleeve is bonded to the coupling nut using and hot melt adhesive such as a polyamide or ethylene vinyl acetate copolymer based adhesives. A curable adhesive such as an epoxy or unsaturated polyester adhesive may be used, if desired.

If the coupling nut is of smaller diameter that the insulated termination, the diameter of the coupling nut can be built up by bonding thereto polymeric tape or a tubular article, which may be a heat recoverable article.

Figure 3:
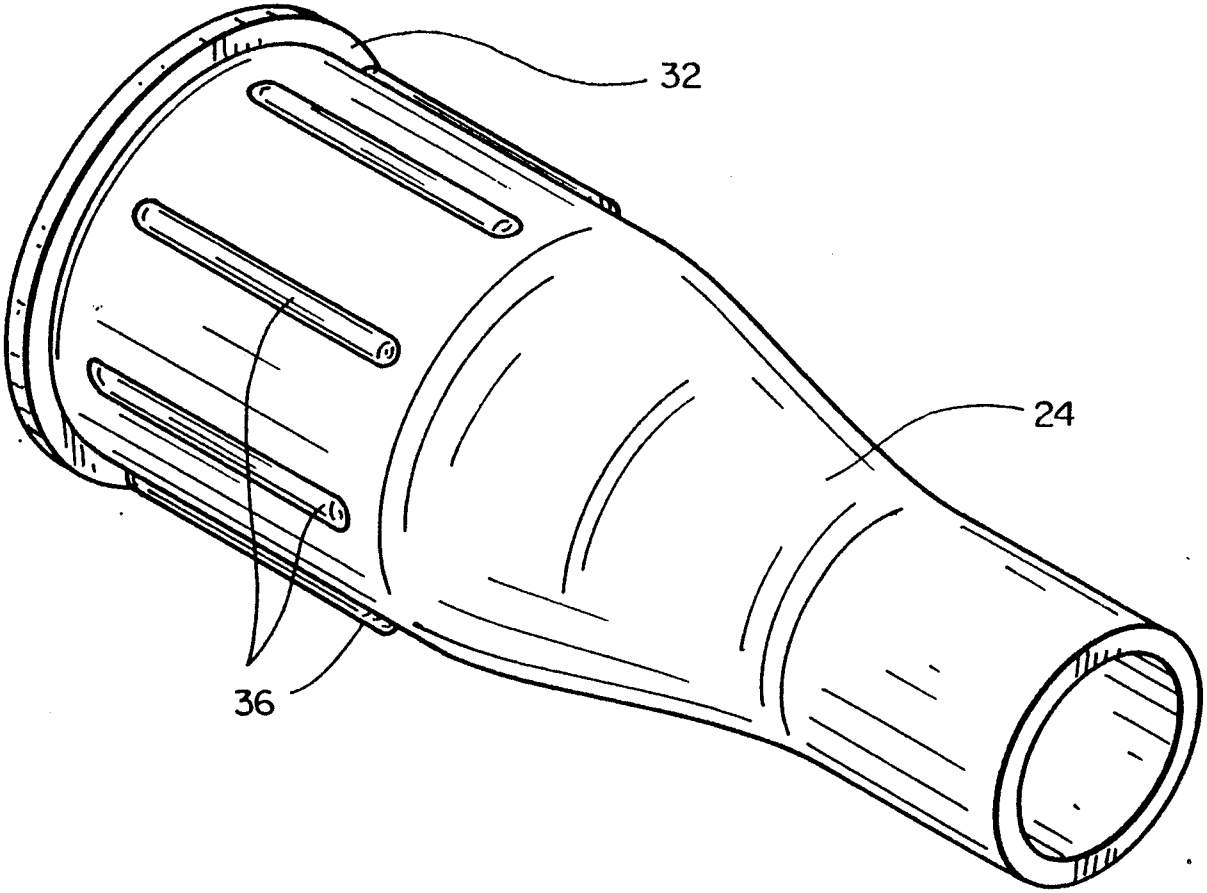
FIG. 3 shows a preferred polymeric sleeve prior to its installation over the cable end and connector.

A layer of encapsulant is positioned between the sleeve and the underlying cable. The layer of encapsulant may be a sealing material such as a grease or a gel. A preferred encapsulant is a gel. The gel preferably has a Voland Hardness of about 1 to about 525 g., more preferably about 5 to about 300 g, and most preferably about 5 to about 100 g., and also preferably has an ultimate elongation of at least about 50%, preferably at least about 100%. The elongation is measured according to the procedures of ASTM D217. The Voland hardness is measured using a Voland-Stevens Texture analyser Model LFRA having a 1000 g load cell, a 5 gram trigger, and a ¼ inch (6.35 mm) ball probe. For measuring the hardness of a gel a 20 ml glass scintillating vial containing 10 grams of gel is placed in the Voland-Stevens Texture analyser and the stainless steel ball probe is forced into the gel at a speed of 2.0 mm a second to a penetration distance of 4.0 mm. The Voland Hardness value of the gel is the force in grams required to force the ball probe at that speed to penetrate or deform the surface of the gel the specified 4.0 mm. The Voland Hardness of a gel may be directly correlated to the ASTM D217 cone penetration hardness and the procedure and a correlation is shown in FIG. 3 of U.S. Pat. No. 4,852,646 to Dittmer et al, the disclosure of which is incorporated herein by reference.

The gel is preferably a liquid-extended polymer composition. The polymeric component can be for example, a silicone, polyorgano siloxane, polyurethane, polyurea, styrene-butadiene and/or styreneisoprene block copolymers. The gels may be formed from a mixture of such polymers. The layer of gel may comprise a foam impregnated with the gel. Examples of gels can be found in U.S. Pat. Nos. 4,600,261 to Debbaut, 4,716,183 to Gamarra et al, 4,777,063 to Dubrow et al 4,864,725 to Debbaut et al, and 4,865,905 to Debbaut et al, European published patent application No. 204,427 to Dubrow et al and International published patent applications Nos. 86/01634 to Toy et al, and WO 88/00603 to Francis et al and commonly assigned copending U.S. applications Ser. Nos. 317,703 filed Mar. 1, 1990 to Dubrow et al and 485,686 filed Feb. 27, 1990 to Rinde et al. The entire disclosures of the above are incorporated by reference herein for all purposes. The gel may be impregnated in a matrix such as a foam or fabric. Gel impregnated in a matrix is disclosed in U.S. Pat. Nos. 4,690,831 to Uken et al and 4,865,905 to Debbaut et al, the entire disclosures of which are incorporated herein by reference for all purposes.

In a preferred embodiment of the invention, the encapsulant layer is applied in the form of one or more wraps of a self-supporting, reinforced strip of silicone gel. A typical tape or strip of gel suitable for use in this invention is described for example in U.S. Pat. No. 4,865,905 to Uken, the entire disclosure of which is incorporated herein by reference. The gel strip is applied to the cable before the polymeric sleeve is installed.

A further layer of gel is also positioned between the edge of the connector and the bulkhead. This layer of gel may take the form of a gasket of gel placed against the bulkhead. In a preferred embodiment, the gel is provided in a annular, deformable, polymeric cap. In this embodiment of the invention, the polymer sleeve may be provide with a flange, as described more fully with regard to FIG. 1.

Turning now to the drawings, FIG. 1 shows in partial cross-section an environmentally protected cable connection according to the invention. In FIG. 1, cable 10, is joined to connector 12, which consists of connector body 12, coupling nut 14 and insert 16. Wires 18 of the cable are electrically connected to terminals (not shown) within insert 16. The cable shield 20 is connected to the connector insert. An initial polymeric sleeve 22 has been installed over the cable termination. This sleeve is preferably a heat shrinkable sleeve which has been recovered onto the connector insert and cable jacket and is bonded thereto. The use of the initial polymeric sleeve in this manner is a conventional technique for use when the cable clamp section of the connector is metallic. It is within the scope of this invention to environmentally protect connections in which the cable clamp of the connector is polymeric and a mold in place insulation is present over the cable end adjacent the coupling nut. An additional polymeric sleeve 24 is a heat recoverable sleeve of the assembly of this invention and has been recovered onto the coupling nut 14 of the connector and bonded thereto using a hot melt polyamide-based adhesive. The polymeric sleeve preferably extends to the edge of the coupling nut. Encapsulant 26 is positioned between the initial polymeric sleeve and the polymeric sleeve of the assembly of this invention. The encapsulant is preferable a silicone gel and preferably applied in strip or tape form, as discussed above. The encapsulant permits rotational (or circumferential) motion between the cable and the outer polymeric sleeve.

Cap 28 is filled with a further layer of encapsulant 30, which is preferably a silicone gel. Flange 32 of polymeric sleeve 24 applies force to the gel within the cap as the coupling nut is screwed onto its mating connector receptacle 33 on bulkhead 34. The cap is dimensioned so that the hardware (consisting of a flange and bolts) 35 mounting the connector receptacle to the bulkhead is covered by the cap 28 and the encapsulant 30 within the cap. The arrangement of the cap and the flange on the polymeric sleeve provides continuing force on the encapsulant maintaining it in sealing contact with the fastening hardware, connector receptacle and bulkhead.

As mentioned above the polymeric sleeve over the layer of encapsulant permits rotational motion between the cable and the sleeve. When connecting the coupling nut to the receptacle up to five rotations of the nut may be required to screw the nut into the receptacle. It has been found that the encapsulant may exude from beneath the sleeve after repeated rotations. To limit such exudation, internal circumferential ribs (not shown) may be provided in the polymeric sleeve. It is preferred that the encapsulant be positioned under the sleeve at a location toward the coupling nut. This can result in the sleeve at its other end touching the cable jacket. To provide for rotational motion of the sleeve, a lubricant, such as a silicone oil, may be applied to the cable jacket in that region.

Figure 2:
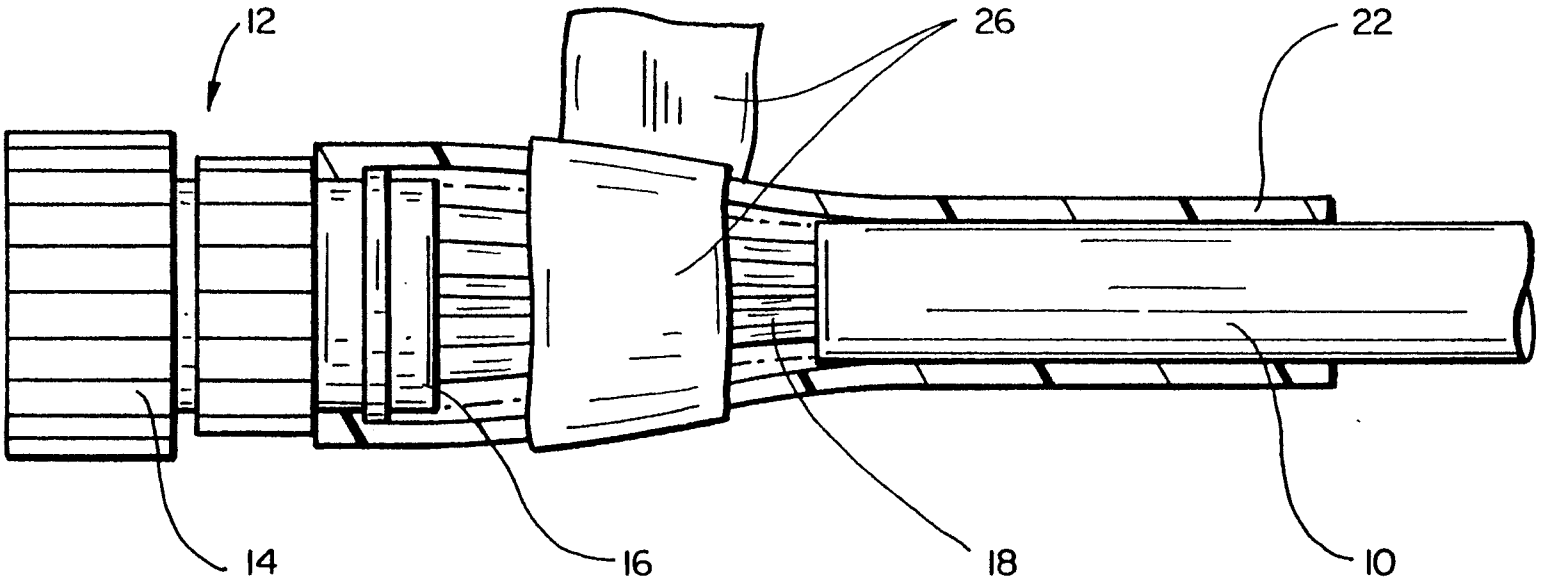
FIG. 2 shows application of a layer of gel to the underlying cable end prior to installation of a polymeric sleeve over the cable end and connector.

FIG. 2 shows the application of encapsulant 26 to cable 10 in the form of a self supporting strip of reinforced silicone gel. It is to be understood that other encapsulants can be used and can be applied in any convenient manner.

FIG. 3 shows a preferred heat recoverable sleeve 24 prior to installation over the cable and connector and includes ribs 36 which aid in gripping the sleeve to unscrew the coupling nut from its mating coupler on the bulkhead. This permits ready demating of the connector which can then be readily replaced. It is preferred to use a replacement for cap 28 when the cable is re-connected to the bulkhead.

While the invention has been described herein in accordance with certain preferred embodiments thereof, many modifications and changes will be apparent to those skilled in the art. Accordingly, it is intended by the appended claims to cover all such modifications and changes as fall within the true spirit and scope of the invention.

What is claimed is:

1. An assembly for environmentally protecting a cable connection in which an end of a cable is connected to a connector having a coupling nut, which assembly comprises:

a) a polymeric sleeve positioned over the coupling nut and a segment of the cable adjacent the connector, said polymeric sleeve being secured to said coupling nut so as to prevent motion between the sleeve and the nut; and b) a layer of encapsulant positioned between at least a portion of the polymeric sleeve and the underlying cable, the encapsulant providing a circumferential environmental seal between the cable and the sleeve while permitting rotational motion between the cable and the sleeve.

2. An assembly in accordance with claim 1, wherein the connector is coupled to a connector receptacle mounted with metallic fastening means in a bulkhead and which further comprises a further layer of encapsulant extending from the polymeric sleeve over said fastening means and a portion of the bulkhead.

3. An assembly in accordance with claim 1, wherein said polymeric sleeve is a dimensionally recoverable sleeve.

4. An assembly in accordance with claim 1, wherein said polymeric sleeve is heat shrinkable.

5. An assembly in accordance with claim 1, wherein said encapsulant is a gel.

6. An assembly in accordance with claim 5, wherein said gel is reinforced.

7. An assembly in accordance with claim 1, wherein said encapsulant is a reinforced silicone gel.

8. An assembly in accordance with claim 2, wherein said further layer of encapsulant is contained within an annular-shaped polymeric cap.

9. A method of environmentally protecting a cable connection in which an end of a cable is connected to a connector having a coupling nut, which method comprises:

a) positioning a polymeric sleeve over the coupling nut and a segment of the cable adjacent the connector;

b) securing the polymeric sleeve to the coupling nut so that motion between the sleeve and the nut is prevented; and c) positioning an encapsulant between at least a portion of the sleeve and the underlying cable such that rotational motion is permitted between the cable and the sleeve and an environmental seal is obtained therebetween.

10. A method in accordance with claim 9, which further comprises the step of securing the coupling nut to a connector receptacle mounted with metallic fastening means in a bulkhead and positioning a further layer of encapsulant such that it extends over the fastening means and a portion of the bulkhead.

11. A method in accordance with claim 10, wherein the further layer of encapsulant is contained in an annular cap and said step of positioning said further layer of encapsulant comprises placing the cap between the coupling nut and then coupling the nut to the connector receptacle.

12. A method in accordance with claim 11, wherein the method further comprises the step of applying a force to the further layer of encapsulant.

13. A method in accordance with claim 12, wherein the polymeric sleeve is provided with a flange that engages the cap and force is applied to the further layer of encapsulant by coupling the nut to the connector receptacle in such a manner that the flange applies a force to the cap and thereby to the encapsulant.

14. A method in accordance with claim 9, wherein the step of positioning an encapsulant between at least a portion of the sleeve and the cable comprises applying a tape of encapsulant around the cable before installing the polymeric sleeve.

15. A method in accordance with claim 9, wherein the step of positioning the polymeric sleeve over the coupling nut and cable comprises positioning a heat shrinkable sleeve around the coupling nut and cable and then applying heat to cause the sleeve to shrink into contact with the nut and cable.

16. An assembly in accordance with claim 1, wherein the connector comprises an electrical connector.

* * * * *